US007722341B2

(12) United States Patent
Jeong et al.

(10) Patent No.: US 7,722,341 B2
(45) Date of Patent: May 25, 2010

(54) SCROLL COMPRESSOR HAVING VARIABLE HEIGHT SCROLL

(75) Inventors: Chan-Hwa Jeong, Gyeongsangnam-Do (KR); Hong-Gyun Jin, Gyeongsangnam-Do (KR); Hae-Jin Oh, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 388 days.

(21) Appl. No.: 11/714,249

(22) Filed: Mar. 6, 2007

(65) Prior Publication Data

US 2007/0212246 A1 Sep. 13, 2007

(30) Foreign Application Priority Data

Mar. 7, 2006 (KR) ..... 10-2006-0021469

(51) Int. Cl.
*F03C 2/00* (2006.01)
*F04C 18/00* (2006.01)

(52) U.S. Cl. ..... 418/55.2; 418/55.1; 418/55.5; 418/57

(58) Field of Classification Search ..... 418/55.1–55.6, 418/57, 142
See application file for complete search history.

(56) References Cited

U.S. PATENT DOCUMENTS 4,627,800 A * 12/1986 Matsudaira et al. ..... 418/55.2
6,659,745 B2 * 12/2003 Fujita et al. ..... 418/55.2
7,326,039 B2 * 2/2008 Kim et al. ..... 418/55.5

FOREIGN PATENT DOCUMENTS

| | | | |
|---|---|---|---|
| CN | 1211584 C | | 7/2005 |
| JP | 61-197787 | | 9/1986 |
| JP | 02-009974 | | 1/1990 |
| JP | 04-153589 | | 5/1992 |
| JP | 05026187 A | * | 2/1993 |
| JP | 06-137283 | | 5/1994 |
| JP | 07019187 A | * | 1/1995 |
| JP | 2002-322987 | | 11/2002 |
| JP | 2005009332 A | * | 1/2005 |

OTHER PUBLICATIONS

Chinese Office Action dated May 23, 2008.
Japanese Office Action dated Sep. 25, 2009.

* cited by examiner

*Primary Examiner*—Theresa Trieu
(74) *Attorney, Agent, or Firm*—KED & Associates, LLP

(57) ABSTRACT

A scroll compressor is provided. The scroll compressor includes a fixed scroll and an orbiting scroll, each with a wrap extending from a plate. The wrap or the plate may have different heights so as to prevent a gap from forming between the end of one of the wraps and the opposite plate. Accordingly, performance of the compressor may be enhanced even if manufacturing tolerances are not precisely controlled or the compressor operates for an extended period of time. Furthermore, frictional loss due to increased frictional area of an edge of the plate may be prevented, and refrigerant leakage due to separation between the wrap and the plate may be prevented.

18 Claims, 10 Drawing Sheets

SCROLL COMPRESSOR HAVING VARIABLE HEIGHT SCROLL

This claims priority to Korean Application No. 10-2006-0021469, filed in Korea on Mar. 7, 2006, the entirety of which is incorporated herein by reference.

BACKGROUND

1. Field

This relates to a compressor, and more particularly, to a scroll compressor.

2. Background

Compressors convert mechanical energy into compressive energy. Compressors may be classified into a variety of different types, including, for example, reciprocating, scroll, centrifugal and vane types. Scroll compressors may be further classified into low pressure and high pressure types, based on whether a suction gas or a discharge gas is filled in a casing thereof. In a scroll compressor, two scrolls perform a relative orbiting motion, and a pair of substantially symmetrical compression chambers are formed between the two scrolls. As the compression chambers consecutively move towards a center of the scroll, a volume of the compression chamber is decreased, thus compressing a refrigerant held therein. The pair of compression chambers may include a high pressure side compression chamber and a low pressure side compression chamber. In some instances, refrigerant inside the high pressure side compression chamber may leak into the low pressure side compression chamber, thus degrading performance of the compressor.

BRIEF DESCRIPTION OF THE DRAWINGS

The embodiments will be described in detail with reference to the following drawings in which like reference numerals refer to like elements wherein.

DETAILED DESCRIPTION

Figure 1:
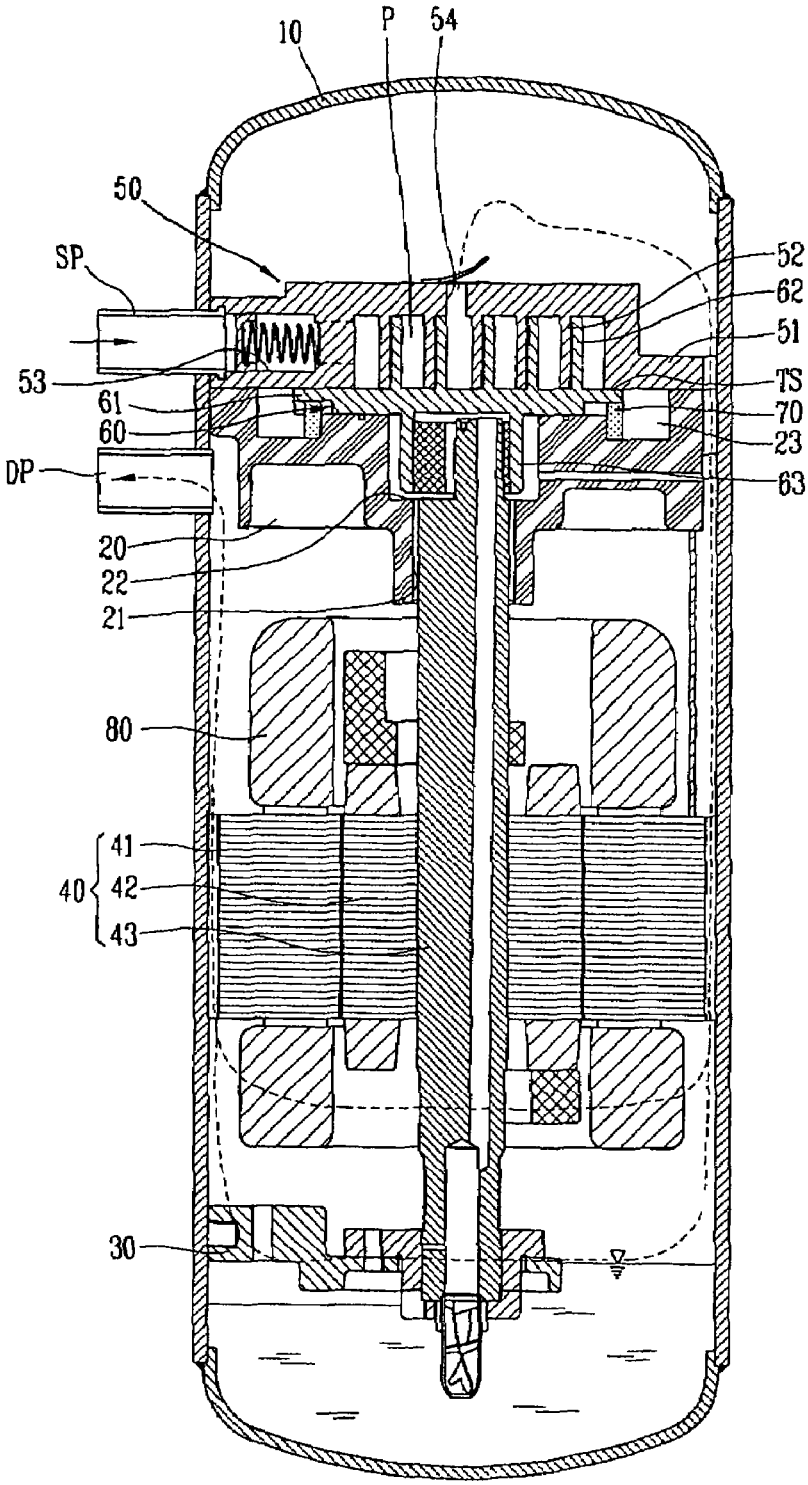
FIG. 1 is a sectional view of an exemplary high pressure type scroll compressor.

The exemplary high pressure type scroll compressor shown in FIG. 1 may include a casing 10 that forms a hermetic inner space, and a main frame 20 and a sub frame 30 fixed to upper and lower sides of the casing 10, respectively. A driving motor 40 may be provided between the main frame 20 and the sub frame 30 to generate a rotation force. A fixed scroll 50 may be fixed to an upper surface of the main frame 20 so as to communicate with a gas suction pipe SP. An orbiting scroll 60 having an involute wrap 62 may perform an orbiting motion through its inter-engagement with a wrap 52 of the fixed scroll 50 so that a plurality of paired compression chambers P are formed. An Oldham's ring 70 may be disposed between the orbiting scroll 60 and the main frame 20, and orbits the orbiting scroll 60. A shaft hole 22, a boss portion receiving groove 22, and a back pressure groove 23 may also be formed in the main frame 20. An inlet 53 and an outlet 54 may be formed in the fixed scroll 50, and a boss portion 63 may be formed in the orbiting scroll.

When power is supplied to a winding coil 80 of the driving motor 40, a driving shaft 43 is rotated together with a rotor 42, and the orbiting scroll 60 performs an orbiting motion at an upper surface of the main frame 20. The engagement of the wraps 52 and 62 forms a pair of compression chambers P that progressively move towards the center of the scroll as the orbiting scroll 60 orbits, with a volume decreasing as they approach the center, thereby compressing a refrigerant in the compression space P.

A lower surface of a plate 61 of the orbiting scroll 60 is disposed on an upper surface of the main frame 20, thus forming a lower side thrust bearing surface (TS). An outer circumferential surface of an upper surface of the plate 61 comes in contact with a lower surface of a plate 51 of the fixed scroll 50, thus forming an upper side thrust bearing surface (TS). The lower surface of the plate 51 of the fixed scroll 50 contacts the end of the wrap 62 of the orbiting scroll 60, and the end of the wrap 52 of the fixed scroll 50 contacts the upper surface of the plate 61 of the orbiting scroll 60, thereby preventing a refrigerant inside the high pressure side compression chamber from leaking into the lower pressure side compression chamber.

Figure 2:
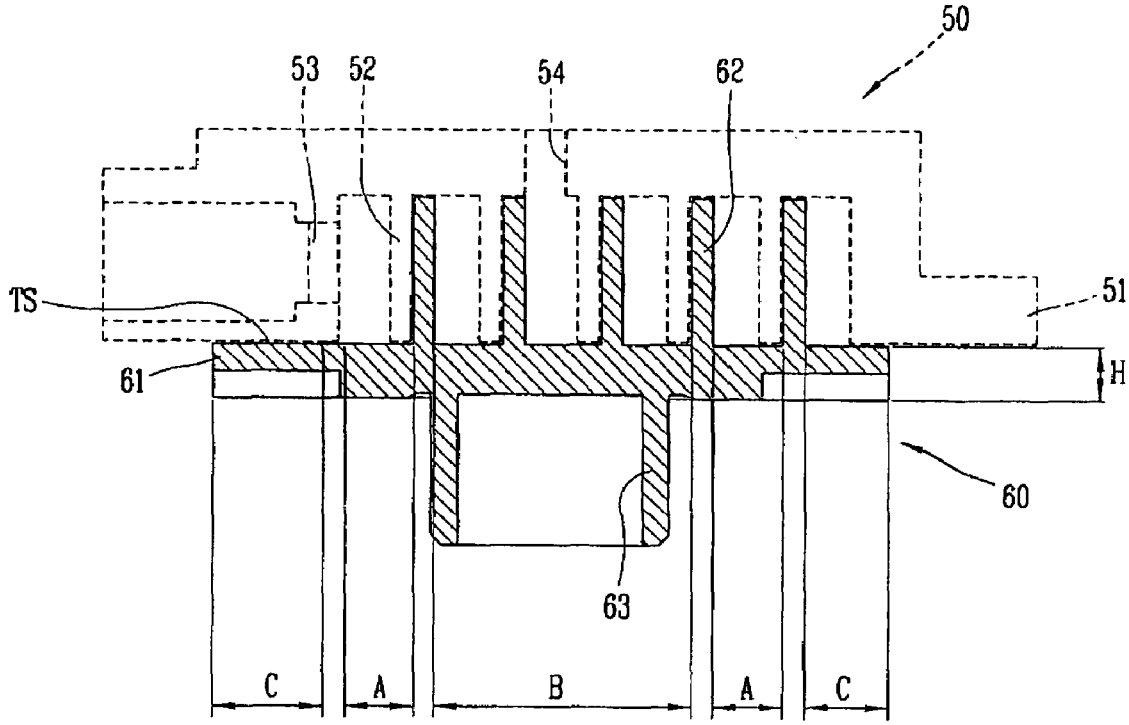
FIG. 2 is a sectional view of an orbiting scroll of the exemplary compressor shown in FIG. 1.

As shown in FIG. 2, the plate 61 of the orbiting scroll 60 has the same height H along sections A, B and C. When manufacturing tolerances of the fixed scroll 50 and the orbiting scroll 60 are imprecise, or the wrap ends are abraded due to extended usage, a gap is generated between each wrap end of the fixed scroll 50 and the orbiting scroll 60 and the corresponding plates 51, 61 which they contact. Accordingly, refrigerant may leak from the high pressure side compression chamber to the low pressure side compression chamber, thereby degrading performance of the compressor.

Figure 3:
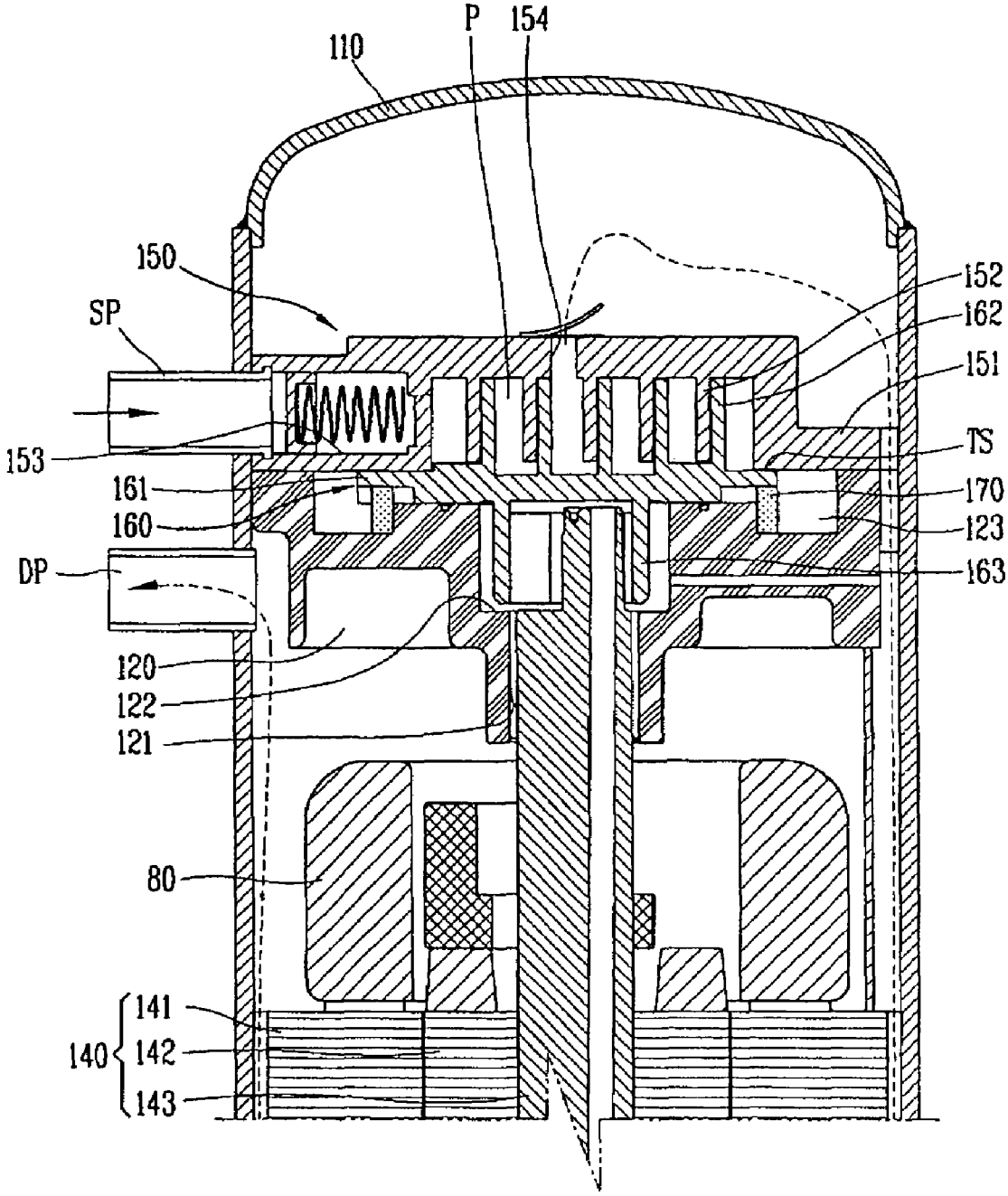
FIG. 3 is a sectional view of an exemplary high pressure type scroll compressor in accordance with embodiments as broadly described herein.
Figure 4:
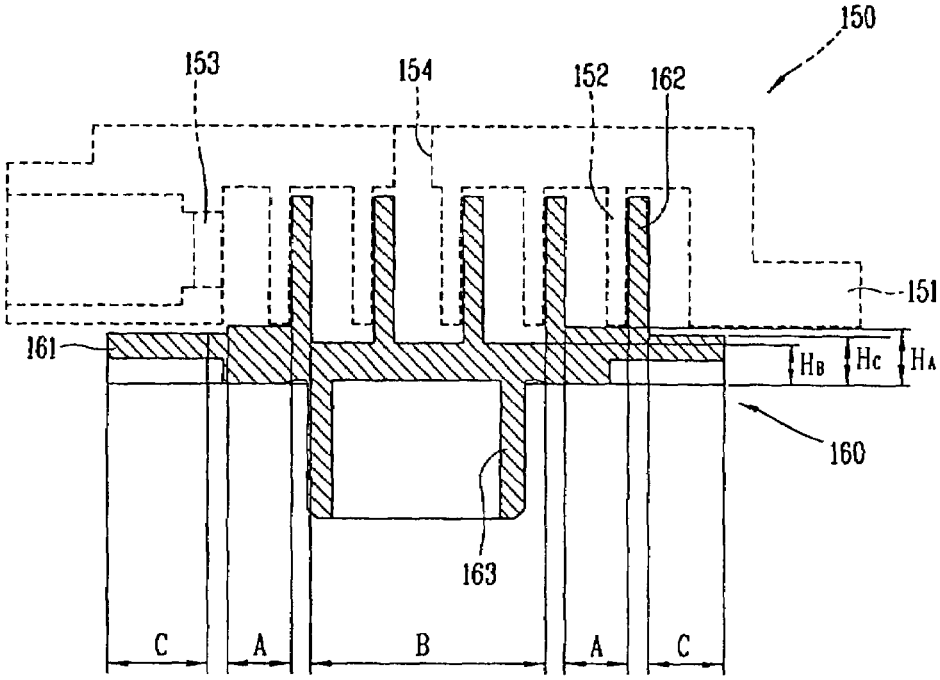
FIG. 4 is a sectional view of an orbiting scroll of the exemplary compressor shown in FIG. 3.
Figure 5:
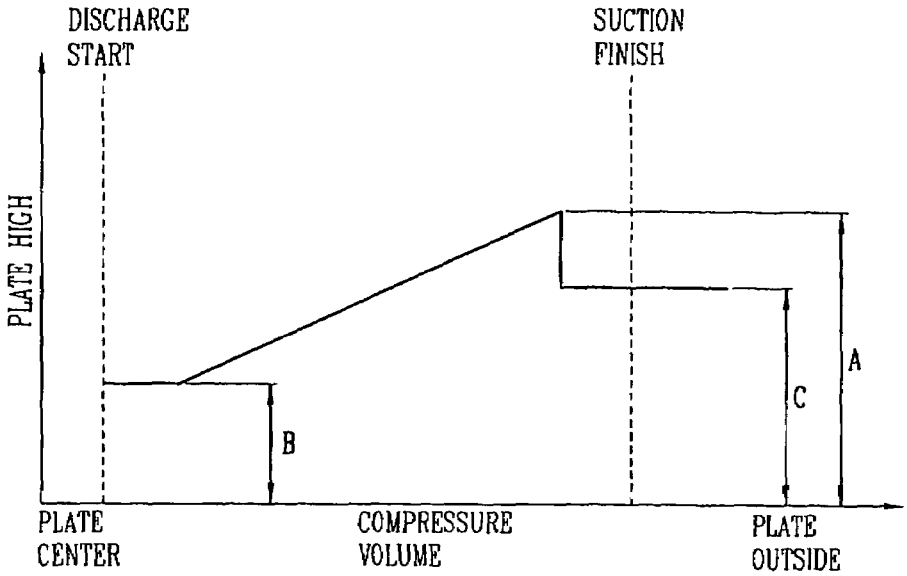
FIG. 5 is a graph of a height of the orbiting scroll shown in FIG. 4.

FIG. 3 is a sectional view of an exemplary high pressure type scroll compressor, and FIGS. 4 and 5 are respectively a sectional view and a graph showing a height of the orbiting scroll at various locations or positions thereof.

The exemplary high pressure type scroll compressor shown in FIG. 3 may include a casing 110 that forms a hermetic inner space, and a main frame 120 and a sub frame (shown in FIG. 1) fixed to upper and lower sides of the inner space of the casing 110. A fixed scroll 150 may be coupled to an upper surface of the main frame 120 so as to communicate with a gas suction pipe SP. An orbiting scroll 160 having an involute wrap 162 may perform an orbiting motion by being engaged with a wrap 152 of the fixed scroll 150 so that a plurality of paired compression chambers P may be formed. An Oldham's ring 170 may be disposed between the orbiting scroll 160 and the main frame 120 so as to prevent the orbiting scroll 160 from rotating. A driving motor 140 including a stator 141 and a rotor 142 may be provided in the casing 110 to generate a rotational force.

The main frame 120 may include a shaft hole 121 at a center thereof for supporting a driving shaft 143. A boss portion receiving groove 122 which allows for orbiting motion of a boss portion 163 of the orbiting scroll 160 may be formed at an upper end of the shaft hole 121. A back pressure groove 123 may be formed as a recess with a predetermined depth at an edge of an upper surface of the main frame 120. The back pressure groove 123 may define an inner volume together with a rear surface of the orbiting scroll 160, and may have a ring shape so that refrigerant gas of a middle pressure may be contained within this inner volume.

The involute wrap 152 of the fixed scroll may have the same height and width as that of the involute wrap 162 of the orbiting scroll 160 so that a pair of compression chambers P may be formed between a lower surface of the plate 151, an upper surface of the plate 161, and the wraps 152, 162. An inlet 153 to receive the gas suction pipe SP may be disposed at one side of the plate 151, and an outlet 154 may be disposed at the center of the plate 151 so as to discharge compressed refrigerant from a final compression chamber into the casing 110. A lower surface of the plate 151 of the fixed scroll 150 may be disposed on the same plane as the end of the wrap 152 so that an outer surface thereof may form a thrust bearing surface (TS) together with an upper surface of the plate 161 of the orbiting scroll 160.

As set forth above, the involute wrap 162 is provided at an upper surface of the plate 161, the wrap 162 having the same height and width as that of the wrap 152 and performing an orbiting motion through its engagement with the wrap 152 of the fixed scroll 150. This allows an inner volume of the compression chamber P to be progressively decreased towards a center of the scroll.

As shown in FIG. 4, the upper surface of the plate 161 of the orbiting scroll 160 has different heights based on a radial position on the plate 161. As shown in FIGS. 4 and 5, among the respective portions of the upper surface of the plate 161 of the orbiting scroll 160, the outermost compression chamber A may have a largest overall volume and a highest height ($H_A$). Likewise, the final compression chamber B positioned at a middle portion of the compression chamber P of the orbiting scroll 160 may have a smallest overall volume and a height ($H_B$) lower than the height $H_A$. In certain embodiments, a difference between the height ($H_A$) of the outermost compression chamber A and the height ($H_B$) of the final compression chamber B may be approximately in a range of approximately $^5/_{10000}$~$^{10}/_{10000}$ of the wrap height, based on thermal expansion characteristics due to temperature differences in the wrap during operation.

A portion C of the plate 161 of the orbiting scroll 160 outside the compression chamber P may have a height ($H_C$) between the height ($H_A$) of the outermost compression chamber A and the height ($H_B$) of the final compression chamber B. Accordingly, excessive leakage of a refrigerant through the thrust bearing surface (FS) formed between the fixed scroll 150 and the orbiting scroll 160, and between the wrap 152 and the wrap 162, may be prevented. In certain embodiments, the difference between the height ($H_A$) of the outermost compression chamber A and the height ($H_C$) of the portion C of the plate 161 outside the compression chamber may be in a range of approximately 0.003~0.03 mm, and, in alternative embodiments, may be less than or equal to or less than approximately 0.02 mm.

It is noted that the term "height" as used herein may describe an overall distance from an uppermost surface of one of the scrolls to its lowermost surface at a particular radial position, when shown in cross section. Likewise, this term may also be used to describe a thickness of one of the plates, measured from an uppermost surface to a corresponding lowermost surface at a particular position when shown in cross section. Similarly, this term may also be used to describe a length of one of the wraps, measured from a distal end to an opposite end adjacent its corresponding plate when shown in cross section.

Operation of the high pressure type scroll compressor in accordance with embodiments as broadly described herein will now be explained.

When power is supplied to a coil 80 of the driving motor 140, the driving shaft 143 rotates, causing the orbiting scroll 160 to orbit a predetermined eccentric distance. While the orbiting scroll 160 progressively moves within the fixed scroll 150, a plurality of paired compression chambers P having decreased volumes towards the center of the scrolls are formed. A refrigerant is sucked into the scrolls, compressed in the chambers, and discharged through the outlet 154 into the casing 110. This process is continuously repeated.

In order for the compressor to generate a desired cooling capacity, manufacturing tolerances of the fixed scroll 150 and the orbiting scroll 160 should be precise so that the wrap 152 of the fixed scroll 150 and the wrap 162 of the orbiting scroll 160 make necessary contact with the respective surfaces of the plates 151 and 161. However, such precise control of manufacturing tolerances increases fabrication cost. Further, over time, the wrap 152 of the fixed scroll 150 and the wrap 162 of the orbiting scroll 160 may be abraded due to continuous operation of the compressor, thus generating a gap through which refrigerant may leak from the high pressure side compression chamber to the low pressure side compression chamber.

To address this problem, as shown in FIGS. 3-5, the bottom surface of the plate 161 of the outermost compression chamber A of the orbiting scroll 160 that forms a suction side first contacts the wrap 152 of the fixed scroll 150 at the time of an initial driving of the compressor, thereby preventing a refrigerant from leaking. Then, the refrigerant is compressed in the compression chamber. Accordingly, even if the manufacturing of the fixed scroll 150 and the orbiting scroll 160 is imprecise or the compressor is used for a long time, refrigerant leakage in a shaft direction is prevented.

Figure 6:
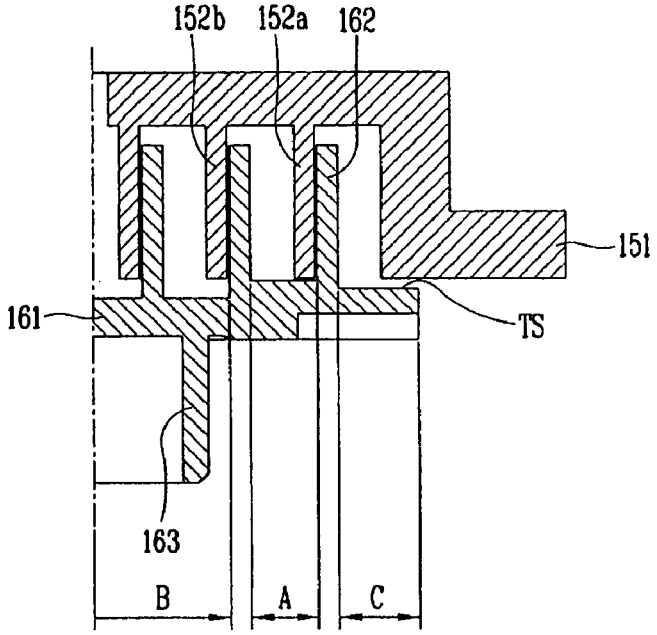
FIGS. 6-8 are cross sectional views of the orbiting scroll shown in FIG. 4 relative to a fixed scroll during operation of the exemplary compressor shown in FIG. 3 in accordance with embodiments as broadly described herein.
Figure 7:
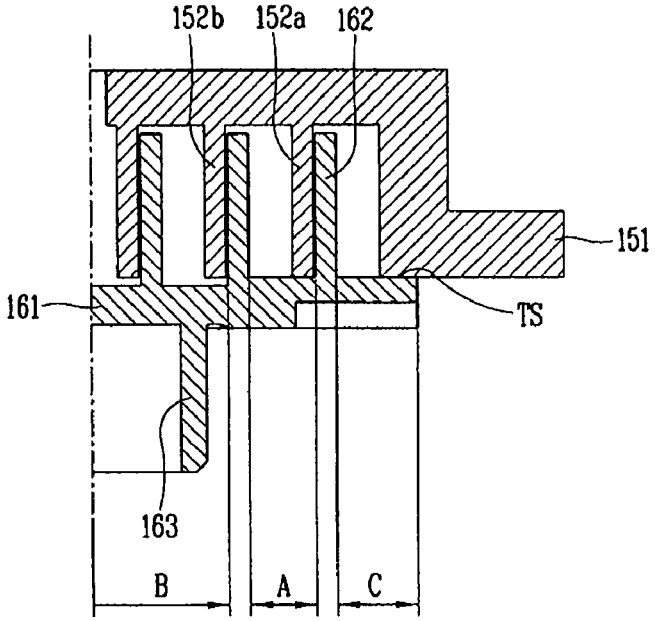

As shown in FIG. 6, at the time of the initial driving of the compressor, only the bottom surface of the outermost compression chamber A (formed by the plate 161 of the orbiting scroll 160) makes close contact with the end of the outermost wrap 152*a* of the fixed scroll 150, thereby sealing the outermost compression chamber A. As shown in FIG. 7, as the outermost wrap 152*a* of the fixed scroll 150 contacts the bottom surface of the outermost compression chamber A during operation, the end of the outermost wrap 152 may be abraded.

To address this problem, a discharge pressure may be applied to the center of a lower surface of the plate 161 by oil sucked through the driving shaft 143, and a mid-level pressure may be applied to an outer portion of a lower surface of the plate 161 that forms a portion of the back pressure groove 123. In contrast, the center of an upper surface of the plate 161 may be supplied with a discharge pressure at the final compression chamber B, and an outer upper surface of the plate 161 may be supplied with a suction pressure by a refrigerant sucked through the inlet 153.

More specifically, because the plate 151 is fixed, and the plate 161 is not fixed, the plate 161 may be shifted in a shaft direction by this pressure difference. At the time of initial driving of the compressor, the pressures at upper and lower sides of the plate 161 are similar to each other. During operation, the pressure of the lower side of the plate 161 is higher than that of the upper side because the lower side of the plate 161 is divided into a high pressure portion 122 and a middle pressure portion 123 which are sealed from one another.

These pressure differentials cause the upper surface of the plate 161 positioned outside the wrap 162 of the orbiting scroll 160 to contact the lower surface of the plate 151 positioned outside the suction chamber of the fixed scroll 150, thereby forming a thrust bearing surface (TS) therebetween and preventing abrasion of the outermost wrap 152*a* and subsequent leakage of refrigerant.

Figure 8:
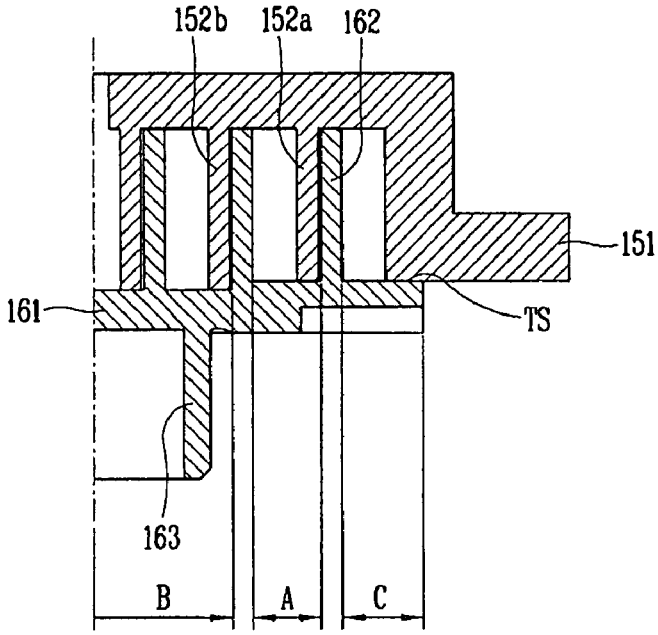

As shown in FIG. 8, the final compression chamber B experiences an increased pressure and temperature during operation. As a result, the final wrap 152*b* and the wrap 162 may be thermally expanded, causing the final wrap 152*b* to contact the lower surface of the final chamber B (formed by the upper surface of the plate 161 of the wrap 162/scroll 160). In certain embodiments, a portion of the plate 161 within the chamber A may be worn away, causing the plate 161 to shift upward due to the difference in pressure and the thrust surfaces TS to come into contact with each other. Thus, even if each end of the wraps 162 and 152*b* contact the corresponding plate 151 and 161 during operation, as shown in FIG. 7, each end of the wraps 162 and 152*b* is thermally expanded by compression heat during operation, as shown in FIG. 8. Accordingly, refrigerant leakage from the final compression chamber B to the outer compression chamber, which has a lower pressure than the final compression chamber B, may be prevented.

A scroll compressor in accordance with a second embodiment will now be explained. In the scroll compressor of the first embodiment, the thickness of the orbiting scroll 160, and in particular, a thickness of the plate 161 and/or a length(s) of the wrap 162, may vary. However, in the scroll compressor shown in FIG. 9, the thickness of the orbiting scroll 160, and in particular, the length(s) of the wrap 162, is substantially uniform, regardless of a radial position along the plate 161. In contrast, the thickness of the fixed scroll 150, and in particular the thickness of the plate 151 and/or a length(s) of the wrap 152, varies based on a radial position along the plate 151.

Figure 10:
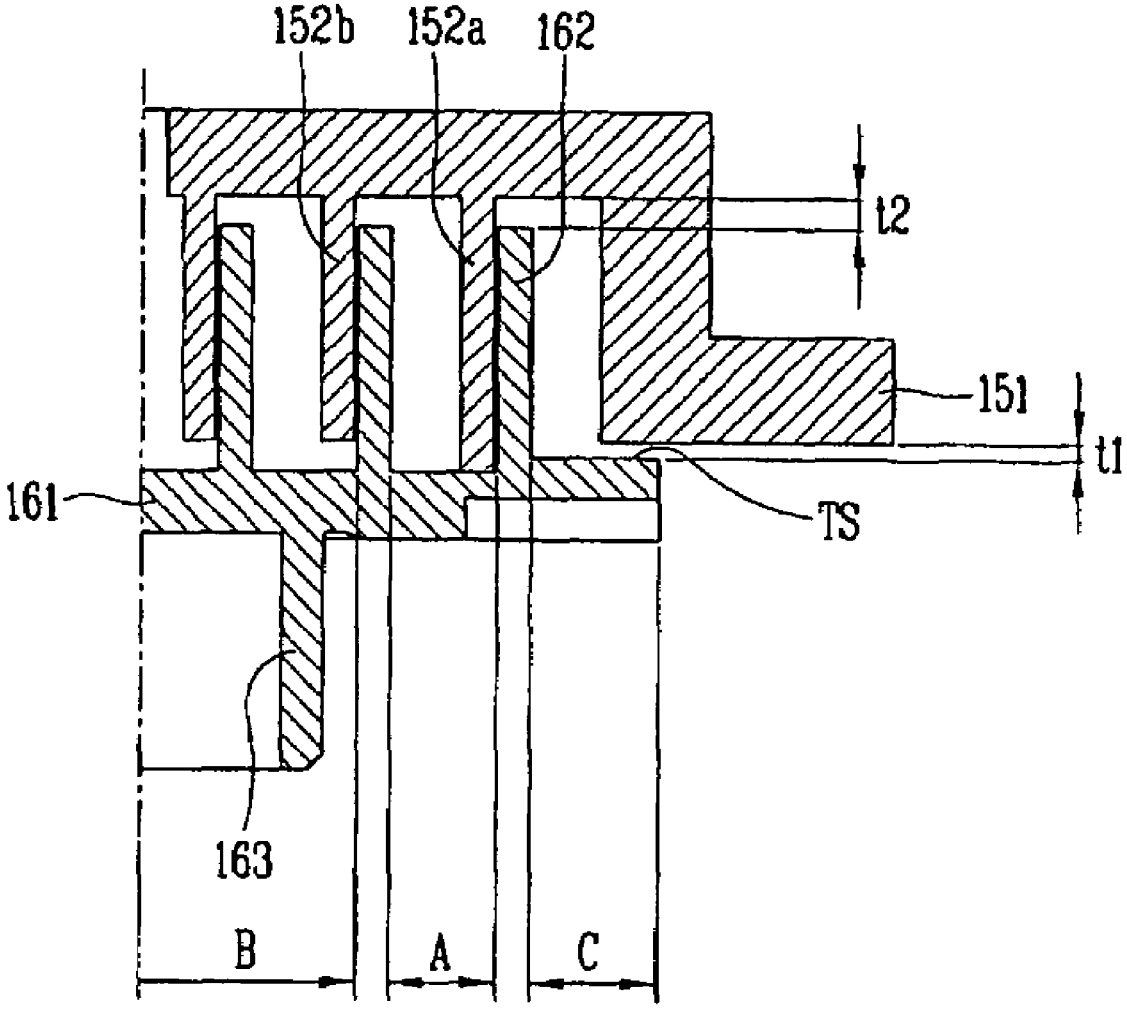

A scroll compressor in accordance with a third embodiment is shown in FIG. 10. In the third embodiment, both the wrap 152 of the fixed scroll 150 and the wrap 162 of the orbiting scroll 160 have different lengths, each based on a radial position along the respective scroll position. Although not shown in detail, it is possible to construct the wrap 152 of the fixed scroll 150 or the wrap 162 of the orbiting scroll 160 with different heights based on such a position.

Figure 9:
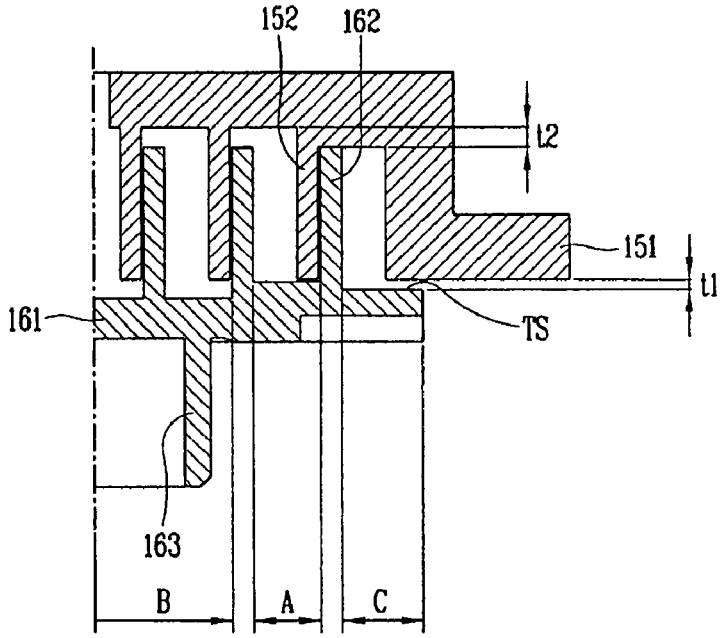
FIGS. 9 and 10 are sectional views of another exemplary scroll compressor in accordance with another embodiment as broadly described herein.

In the second embodiment shown in FIG. 9, the wrap 152 of the fixed scroll 150 extends to a length of the plate 151 outside the wrap 152 of the scroll 150 that forms a thrust bearing surface (TS). However, portions of the fixed scroll 150 may have different heights, and in particular, the length (s) of the wrap 152 may differ, based on a radial position along the plate 151. For example, as shown in FIG. 9, the height of the plate 151 of the fixed scroll 150 may be highest at the middle compression chamber A, and may be the same at right and left compression chambers B and C. In certain embodiments, height difference (t2) of the plate 151 between the middle compression chamber A and the right and left compression chambers B and C may be equal to or larger than a gap (t1) between the plate 161 of the orbiting scroll 160 and the plate 151 outside the wrap 152 of the fixed scroll 150. Other combinations of heights for the compression chambers A, B and C may also be appropriate.

In the third embodiment shown in FIG. 10, the plate 151 of the fixed scroll 150 and the plate 161 of the orbiting scroll 160 have substantially the same height. However, the wrap 152 of the fixed scroll 150 has different heights based on a radial position. For example, the height of the wrap 152 of the fixed scroll 150 may be highest at the middle compression chamber A the inner compression chamber B, and lower at the compression chamber C. A gap (t2) between the compression side of the plate 151 of the fixed scroll 150 and the end of the wrap 162 of the orbiting scroll 160 may be greater than or equal to a gap (t1) between the plate 161 of the orbiting scroll 160 and the plate 151 outside the compression chamber of the fixed scroll 150 that forms a thrust bearing surface (TS). In certain embodiments, only the wrap 162 of the orbiting scroll 160 may have different heights, or both the wrap 152 of the fixed scroll 150 and the wrap 162 of the orbiting scroll 160 may have different heights. The height difference between the wraps may be as set forth with respect to the first embodiment. Other differences in height may also be appropriate.

Referring to FIGS. 9 and 10, 't1' denotes a gap between the fixed scroll 150 and the orbiting scroll 160 at the time of a second contact with each other, and 't2' denotes a gap therebetween at the time of a third contact with each other. Details thereof are based on the sequence shown in FIGS. 6 to 8. An effect of the scroll compressor according to the second and third embodiments is similar to that set forth with respect to the first embodiment, and thus further detailed explanation is omitted.

As the wrap of each of the scrolls or the plates may have different heights, a gap between the end of the wrap and the opposite plate can be prevented even if control of tolerances during manufacturing of the fixed scroll 150 and the orbiting scroll 160 is imprecise or the compressor is operated for an extended period of time. Accordingly, performance of the compressor may be enhanced.

Furthermore, even when an edge of the plate of the orbiting scroll is bent due to different pressures applied thereto, excessive contact and/or friction between the thrust bearing surface of the orbiting scroll and the thrust bearing surface of the fixed scroll may be avoided. This may prevent a frictional loss due to an increase in frictional area. Since the thrust bearing surface serves as a lever, refrigerant leakage due to separation between the end of the wrap and the opposite plate may be prevented.

Figure 11:
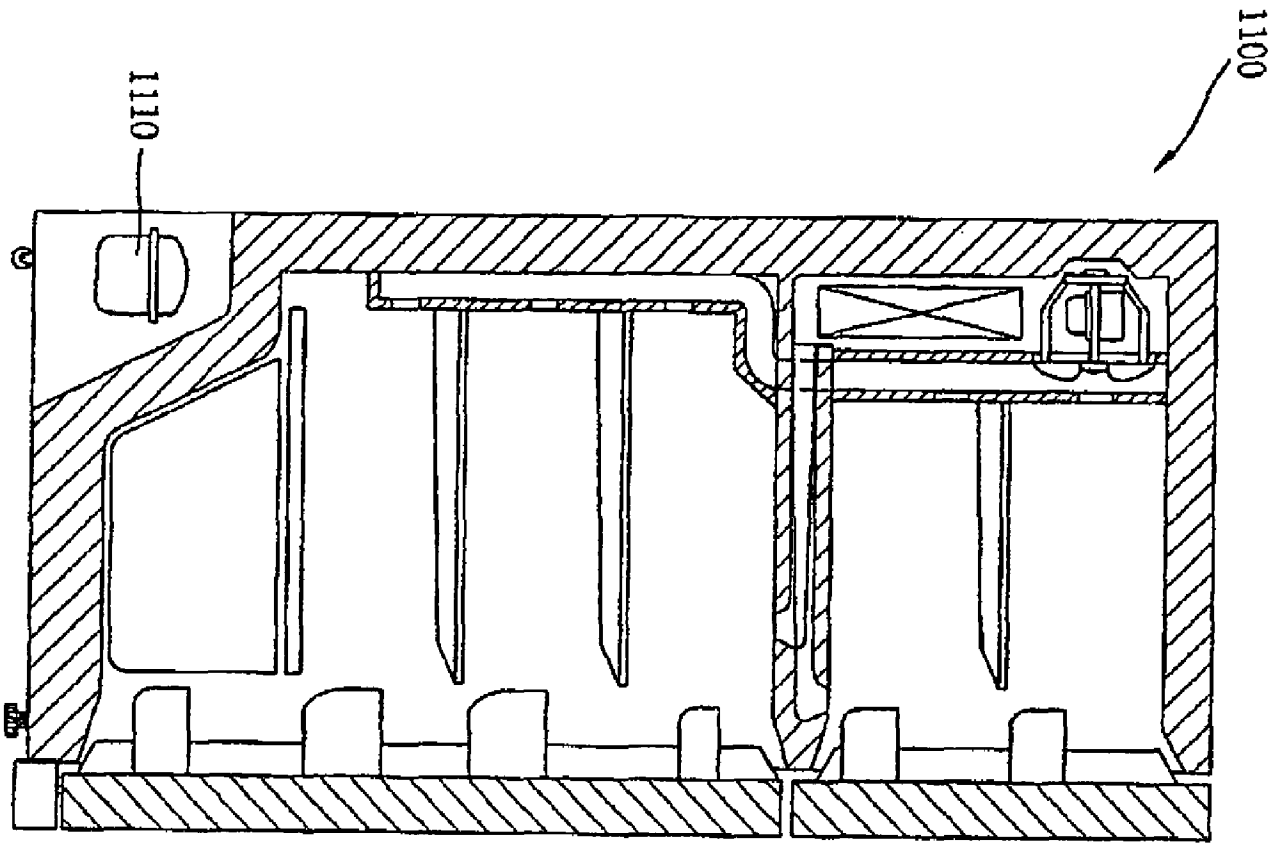
FIGS. 11-13 illustrate exemplary installations of a compressor as embodied and broadly described herein.

The scroll configuration for a scroll compressor as embodied and broadly described herein has numerous applications in which compression of fluids is required. Such applications may include, for example, air conditioning and refrigeration applications. One such exemplary application is shown in FIG. 11, in which a compressor 1110 as embodied and broadly described herein is installed in a refrigerator/freezer 1100. Installation and functionality of a compressor in this type of refrigerator is discussed in detail in U.S. Pat. Nos. 7,082,776, 6,995,064, 7,114,345, 7,055,338 and 6,772,601, the entirety of which are incorporated herein by reference.

Figure 12:
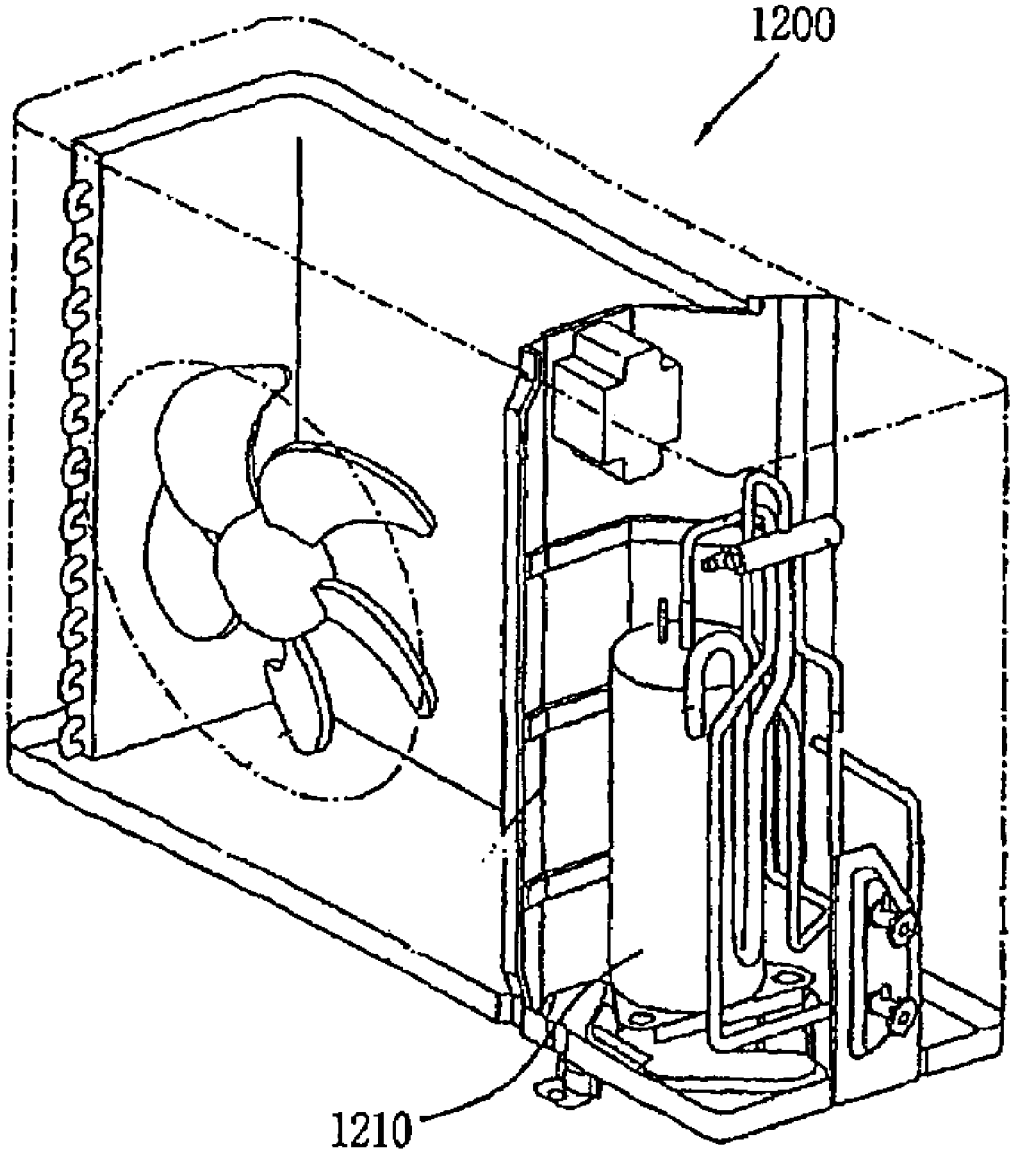

Another such exemplary application is shown in FIG. 12, in which a compressor 1210 as embodied and broadly described herein is installed in an outdoor unit of an air conditioner 1200. Installation and functionality of a compressor in this type of air conditioner is discussed in detail in U.S. Pat. Nos. 7,121,106, 6,868,681, 5,775,120, 6,374,492, 6,962,058, 6,951,628 and 5,947,373, the entirety of which are incorporated herein by reference.

Figure 13:
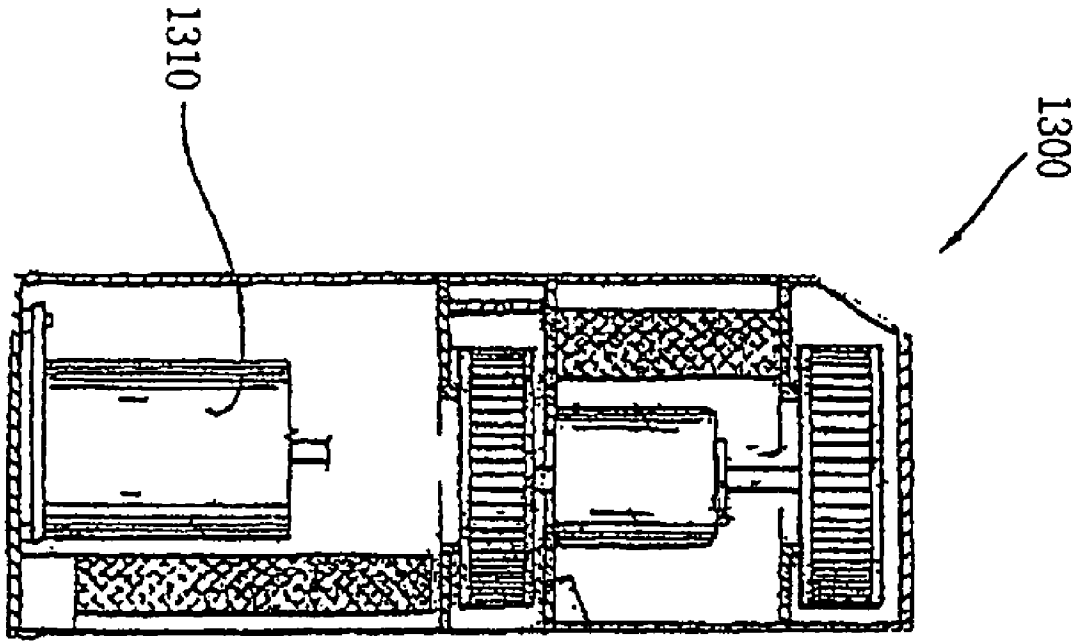

Another such exemplary application is shown in FIG. 13, in which a compressor 1310 as embodied and broadly described herein is installed in a single, integrated air conditioning unit 1300. Installation and functionality of a compressor in this type of air conditioner is discussed in detail in U.S. Pat. Nos. 7,032,404, 6,412,298, 7,036,331, 6,588,288, 6,182,460 and 5,775,123, the entirety of which are incorporated herein by reference.

An object is to provide a scroll compressor capable of preventing a refrigerant from being leaked between each wrap end of a fixed scroll and an orbiting scroll and a plate even if the fixed scroll and the orbiting scroll have a low processing precision or each wrap end thereof is abraded.

To achieve these and other advantages and in accordance with the purpose of embodiments broadly described herein, there is provided a scroll compressor, including a frame fixedly-coupled to inside of a casing, a fixed scroll fixedly-coupled to the frame, and having a wrap at a lower surface of a plate, and an orbiting scroll having a wrap at an upper surface of the plate, and performing an orbiting motion by being engaged with the wrap of the fixed scroll so that a compression chamber may have a decreased volume, wherein the plate or the wrap of at least one of the fixed scroll and the orbiting scroll has different heights according to each position.

To achieve these and other advantages and in accordance with the purpose of embodiments broadly described herein, there is provided a scroll compressor, including a frame fixedly-coupled to inside of a casing, a fixed scroll fixedly-coupled to the frame, and having a wrap at a lower surface of a plate, and an orbiting scroll having a wrap at an upper surface of the plate, and performing an orbiting motion by being engaged with the wrap of the fixed scroll so that a compression chamber may have a decreased volume, wherein a wrap of at least one of the fixed scroll or the orbiting scroll has different heights according to each position.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiments, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a frame coupled to an inside of a casing;

a fixed scroll coupled to the frame, wherein the fixed scroll includes a fixed plate and a fixed wrap extending from a lower surface of the fixed plate; and an orbiting scroll including an orbiting plate and an orbiting wrap extending from an upper surface of the orbiting plate, wherein the orbiting scroll is configured to be engaged with the fixed wrap so as to form a space therebetween, wherein the orbiting scroll is configured to perform an orbiting motion with respect to the fixed scroll such that a volume of the space formed between the fixed an orbiting wraps is progressively decreased so as to form a compression space, and wherein a thickness of at least one of the fixed scroll or the orbiting scroll varies based on a radial position along its respective plate, wherein the compression space comprises a first compression chamber and a second compression chamber, wherein a volume of the first compression chamber is greater than a volume of the second compression chamber, and wherein a thickness of a portion of the at least one of the fixed or orbiting scroll which is outside the first and second compression chambers is less than its thickness in the first compression chamber, and is greater than its thickness in the second compression chamber.

2. The compressor of claim 1, wherein a difference in thickness between a portion of the orbiting plate which is within the compression space and its thickness outside the compression space is between approximately 0.003~0.03 mm.

3. The compressor of claim 1, wherein the compression space comprises a first compression chamber and a second compression chamber, and wherein a height difference between the first compression chamber and the second compression chamber is in a range of approximately $^{5}/_{10000}$~$^{10}/_{10000}$ of a maximum height of the fixed and orbiting wraps.

4. The compressor of claim 1, wherein the inside of the casing is supplied with a discharge pressure.

5. The compressor of claim 4, wherein a discharge pressure is applied to a first portion of a lower surface of the orbiting plate, and a pressure that is lower than the discharge pressure is applied to a second portion of the lower surface of the orbiting plate.

6. A compressor, comprising:

a frame coupled to an inside of a casing;

a fixed scroll coupled to the frame, wherein the fixed scroll includes a fixed plate and a fixed wrap extending from a lower surface of the fixed plate; and an orbiting scroll including an orbiting plate and an orbiting wrap extending from an upper surface of the orbiting plate, wherein the orbiting scroll is configured to be engaged with the fixed wrap so as to form a space therebetween, wherein the orbiting scroll is configured to perform an orbiting motion with respect to the fixed scroll such that a volume of the space formed between the fixed an orbiting wraps is progressively decreased so as to form a compression space, and wherein a thickness of at least one of the fixed scroll or the orbiting scroll varies based on a radial position along its respective plate, wherein the compression space comprises a first compression chamber and a second compression chamber, wherein a volume of the first compression chamber is greater than a volume of the second compression chamber, and wherein a thickness of the at least one of the fixed or orbiting scroll which is within the first compression chamber is greater than its thickness in the second compression chamber.

7. The compressor of claim 6, wherein a difference in thickness between a portion of the orbiting plate which is within the compression space and its thickness outside of the compression space is between approximately 0.003~0.03 mm.

8. The compressor of claim 6, wherein the compression space comprises a first compression chamber and a second compression chamber, and wherein a height difference between the first compression chamber and the second compression chamber is in a range of approximately $^{5}/_{10000}$~$^{10}/_{10000}$ of a maximum height of the fixed or orbiting wrap.

9. The compressor of claim 6, wherein the inside of the casing is supplied with a discharge pressure.

10. The compressor of claim 9, wherein a discharge pressure is applied to a first portion of a lower surface of the orbiting plate, and a pressure that is lower than the discharge pressure is applied to a second portion of the lower surface of the orbiting plate.

11. A compressor, comprising:

a frame coupled to inside of a casing;

a fixed scroll coupled to the frame, and having a fixed wrap at a lower surface of a fixed plate; and an orbiting scroll having an orbiting wrap at an upper surface of an orbiting plate, wherein the fixed and orbiting wraps are configured to be engaged as the orbiting wrap performs an orbiting motion relative to the fixed wrap such that a compression space formed therebetween has a continuously decreasing volume, and wherein a height of at least one of the fixed wrap or the orbiting wrap varies based on a radial position along its respective plate, wherein a thickness of one of the fixed or orbiting plate outside the compression space is less than its thickness within a first portion of the compression space, and is greater than its thickness within a second portion of the compression chamber.

12. The compressor of claim 11, wherein a height of the fixed or orbiting wrap at a portion of the compression space having a first volume is greater than its height at a portion of the compression space having a second volume, wherein the first volume is greater than the second volume.

13. The compressor of claim 11, wherein a height difference between the at least one of the fixed or orbiting wrap and its corresponding plate outside the compression space is between approximately 0.003~0.03 mm.

14. The compressor of claim 11, wherein a height ratio between the fixed and orbiting wraps in the compression space is in a range of approximately $^{5}/_{10000}$~$^{10}/_{10000}$.

15. The compressor of claim 11, wherein the inside of the casing is supplied with a discharge pressure.

16. The compressor of claim 15, wherein a discharge pressure is applied to a first portion of a lower surface of the orbiting plate, and a pressure lower than the discharge pressure is applied to a second portion of the lower surface of the orbiting plate.

17. The compressor of claim 15, wherein a discharge pressure is applied to a first portion of an upper surface of the orbiting plate, and a suction pressure is applied to a second portion of the upper surface of the orbiting plate.

18. The compressor of claim 11, wherein the compressor is used in an appliance that requires compression of fluid.

* * * * *